10/15/85 XR 4,547,173

United States Patent [19]

Jaworski et al.

[11] Patent Number: 4,547,173

[45] Date of Patent: Oct. 15, 1985

[54] TOY VEHICLE CLAW WHEEL

[75] Inventors: Eugene Jaworski, Park Ridge; Jeffrey D. Breslow, Highland Park, both of Ill.

[73] Assignee: Marvin Glass & Associates, Chicago, Ill.

[21] Appl. No.: 678,023

[22] Filed: Dec. 4, 1984

[51] Int. Cl.[4] ..... A63H 29/00

[52] U.S. Cl. ..... 446/457; 446/465

[58] Field of Search ..... 446/465, 462, 433, 434, 446/457, 463, 448, 431, 464, 469; 301/43, 45, 46, 48, 51

[56] References Cited

U.S. PATENT DOCUMENTS 1,781,461 11/1930 Huenemann ..... 301/48

1,890,872 12/1932 Van Kleeck ..... 301/51

FOREIGN PATENT DOCUMENTS 1532724 7/1968 France ..... 301/48

*Primary Examiner*—Mickey Yu

*Attorney, Agent, or Firm*—John S. Pacocha

[57] ABSTRACT

A toy vehicle with a chassis carrying an axle for rotation has a hollow wheel mounted for rotation on the axle. Openings extend through the peripheral wall of the wheel that normally contacts a supporting surface. Inside the wheel a spider is secured to the axle for rotation with a number of legs spaced from the axle. A claw is attached to each of the legs for pivotal movement relative to the leg with the free end of the claw substantially within the wheel. Pivotal movement of the claw relative to the leg is permitted by a "living hinge" which also biases the claw to remain in the wheel. The hollow wheel is normally driven on a smooth surface through engagement with the spider-claw subassembly. However, when the wheel encounters a rough surface or obstruction that tends to cause the wheel to slip, the claws emerge and engage the surface and the vehicle clambers across the obstruction.

20 Claims, 8 Drawing Figures

TOY VEHICLE CLAW WHEEL

BACKGROUND OF THE INVENTION

1. Field of the Invention

This invention relates generally to toy vehicles and more particularly to a wheel and axle assembly for toy vehicles.

2. Background Art

Toy vehicles, in particular, motorized toy vehicles capable of four wheel, or even six wheel, drive such as those disclosed and claimed in prior U.S. Pat. Nos. 4,380,135; 4,467,557; and 4,459,776 that can clamber over various surfaces and obstacles are popular playthings. However, there remains a need for new toy vehicles that can overcome obstacles in an entertaining manner. In real life vehicles there have been attempts, particularly with respect to tractors, to increase traction of the vehicles by extendable lugs as in prior U.S. Pat. Nos. 1,326,500; 1,542,206; 1,578,478; 1,997,835; and 2,924,586. However, such prior art solutions to the problem of increasing traction, and hence the ability of the vehicle to overcome obstructions, are not applicable to toy vehicles.

SUMMARY OF THE INVENTION

The present invention is concerned with providing a wheel and axle assembly for a toy vehicle in which claws extend from the wheel upon the wheel otherwise being unable to overcome an obstruction. This and other objects and advantages of the invention are achieved by a wheel and axle assembly in which a hollow wheel with a peripheral wall is mounted for rotation on an axle and a spider with a leg spaced from the axle has a pivotally attached claw that is driven out, against a bias, through an opening in the peripheral wall of the wheel. Preferably, a four wheel drive toy vehicle is provided with two of each such wheels on each of two driven axles.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
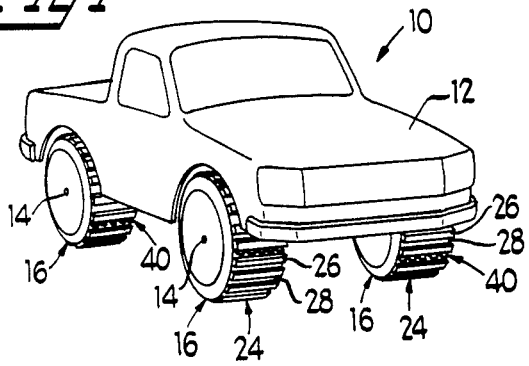
FIG. 1 is a perspective view of a toy vehicle embodying the present invention.

Referring now to the drawing in which like parts are designated by like reference numerals throughout the several views, there is shown in FIG. 1 a toy vehicle 10 having a chassis 12. Spaced apart axles 14 are carried by the chassis 12 for rotation relative to the chassis. A conventional battery motor, spring motor or inertia motor for toy vehicles may be drivingly connected by conventional means to one or both of the axles to rotate them in one direction, as shown, for example, in U.S. Pat. Nos. 3,359,680; 3,501,863; 3,540,152; 3,583,097; 3,810,515; 3,955,429; 3,959,920; and 3,981,098.

Each end of each axle 14 has a hollow wheel 16 mounted adjacent the end for rotation relative to the axle. Mating shell halves 17 and 18 form each wheel. An opening 20 in the side wall of each of the shell halves is aligned with another opening in the respective mating shell half. The openings 20 are sized to receive an axle 14 for rotation of the assembled hollow wheel 16 relative to the axle 14. Each pair of shells 17 and 18 fit together along a parting line 22 and together form a peripheral wall 24, the outside of which contacts the supporting surface for the toy vehicle. Formed along the outer surface of the peripheral wall 24 are alternating raised threads or lugs 26 and recessed spaces 28. Raised lugs 26 are generally parallel to the axle 14 and extend across the entire width of the outer surface of the peripheral wall 24.

Conveniently formed in substantially equidistant ones of the recessed spaces 28 are four openings 30 that also extend substantially across the entire width of the peripheral wall 24. As will become apparent to those skilled in the art there may be a greater or lesser number of the openings 30. However, it has been found that three or four openings are preferred. Similarly, the openings 30 need not extend across the entire width of the peripheral wall 24 but again such greater width has been found to provide a more dramatic effect.

Figure 3:
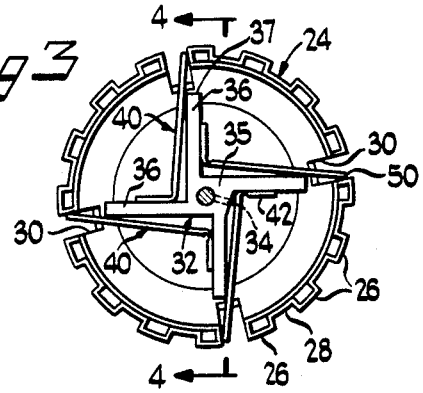
FIG. 3 is an enlarged side elevational view of one of the wheel and axle assemblies with the outer shell of the wheel removed and the claws retracted.
Figure 5:
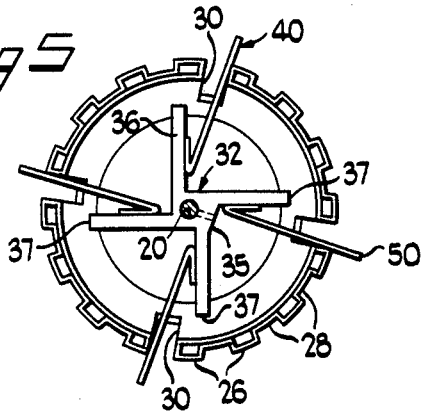
FIG. 5 is a elevational view similar to that of FIG. 3 but with the claws extended.

Within each wheel 16, a spider 32 is secured to the axle 20 for rotation with the axle. As shown in FIG. 3, a setscrew 34 may be used to secure the center 35 of the spider 32 to the axle 14. Other alternative methods (not shown) such as a tight friction fit, a keyway or adhesives may also be used. Spider 32 has four legs 36 each extending, generally transverse to the axle 20, outwardly from the axle receiving center 35. Each of the legs 36 has an outer end 37. As illustrated in FIGS. 3 and 5 the legs 36 are generally tangent to the axle 20, however they could instead extend radially.

Attached to each of the legs 36 is a claw 40 that is made of a plastic material. One end 42 of the claw is provided with apertures 44 for attachment to a leg 36 by means of screws 46 or other fasteners. The other, free end 48 is formed with a series of serrations or teeth 50. Intermediate the end 42, adjacent which the claw will be attached to the leg, and the free end 48 is a section 52 of reduced material thickness that extends across the entire width of the claw 40 to provide an integral hinge which is sometimes referred to as a "living hinge". Accordingly, each claw 40 is mounted on a respective leg 36 for pivotal movement relative to the leg about an axis parallel to the axis of the axle 20 to which the spider is secured.

Figure 6:
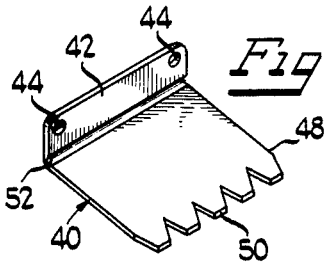
FIG. 6 is an enlarged scale perspective view of one of the claws.

Hinge section 52 also provides a bias resulting from the inherent resiliency of the plastic material. Thus, as the claw is illustrated in FIG. 6 with the one end 42 substantially transverse to the free end 48, there is a biasing force tending to urge the two ends into the same plane. Each claw 40 may pivot relative to the leg to which it is attached in either direction of rotation of the axle to which the spider is attached. However, the claws are oriented to pivot upon rotation of the axle in one direction so as to extend out a respective opening 30 and are biased by the "living hinge" in the opposite direction of rotation of the axle.

Figure 2:
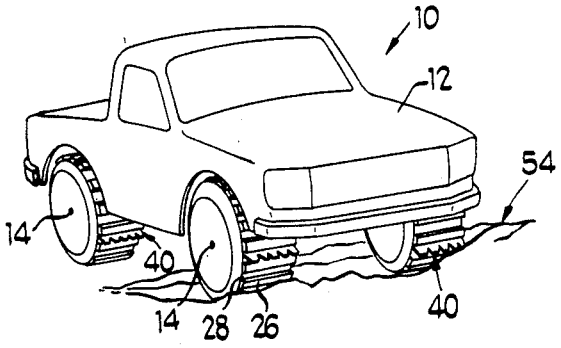
FIG. 2 is a perspective view of the vehicle shown in FIG. 1 with the claws extending out of the wheels.
Figure 4:
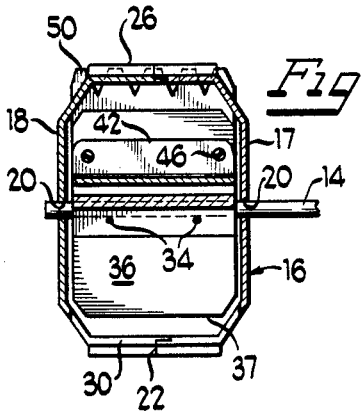
FIG. 4 is a sectional view taken generally along the line 4—4 of FIG. 3.

The free end 48 of each of the claws 40 attached to a respective one of the legs 36 engages wheel 16 at a respective one of the openings 30 as illustrated in FIGS. 3 and 4. Accordingly, rotation of the axle 20 is transmitted through engagement of the spider 32 and claws 40 subassembly with the wheel 16 to rotate the wheel across a relatively smooth supporting surface. However, when the wheels 16 or more particularly the outer surface of the peripheral wall 24 contacts a rough or obstructive surface such as 54 in FIG. 2, the engagement between the spider-claw subassembly and the wheel is overcome and the outer surface of the peripheral wall 24 slips. As the hollow wheel 16 begins to slip, the continued clockwise rotation of the axle 20 and the spider 32 causes each of the claws 40 to extend out through a respective opening 30 as illustrated in FIGS. 2 and 5. The extended claws 40 then contact the obstructions and enable the driven toy vehicle 10 to overcome the obstructions which caused the wheel 16 to slip or spin. After the rough surface has been overcome, claws 40 are retracted as a result of a bias from the "living hinge" 52. Extension of the claws 40 may be demonstrated by grasping an individual hollow wheel 16 and rotating the wheel counterclockwise as the axle remains stationary.

Figure 7:
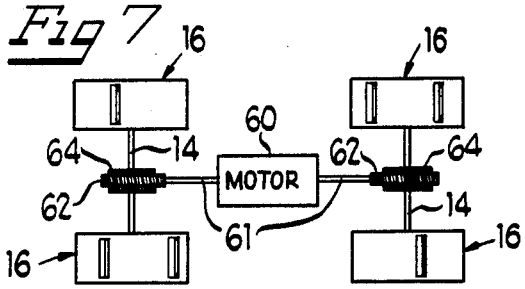
FIG. 7 is a schematic showing of the motor drive assembly.

A motor and drive assembly that may be carried by the chassis 12 for the spaced apart axles 14 is schematically shown in FIG. 7. Extending out from each end of motor 60 is a output shaft 61 with a worm gear 62. Each of the axles 14 has a gear 64 secured to the axle for rotation with the axle and engaging worm gear 64. Thus, the motor simultaneously drives both of the axles 14.

In the illustrated embodiment, claw 40 is formed as a separate piece and attached to the respective leg 36 between the center portion 35 of the spider 32 and the outer end 37 of the leg. The portion of the leg 36 extending beyond the section to which the claw 40 is attached abuts claw 40 when the claw is extended and thus prevents each leg 36 and its attached claw 40 overriding, or going beyond, the respective opening 30. It may be desirable to form spider 32 with legs 36 and claws 40 as a single plastic piece. The section of reduced material thickness forming the "living hinge" could then be formed at the junction of the outer end 37 of the leg 36 and the one end 42 of the claw 40. In such a modification, stops, such as tabs or inward projections, (not shown) would have to be provided inside wheels 16 to prevent each leg and claw from rotating beyond the respective opening 30.

Figure 8:
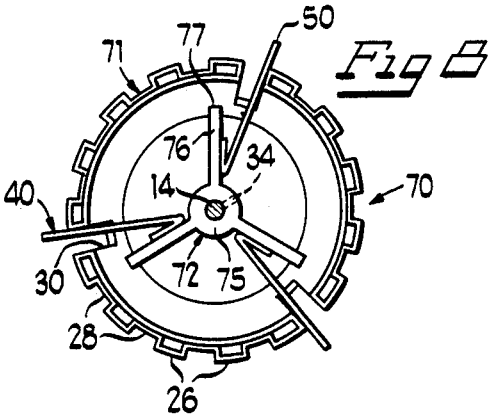
FIG. 8 is an elevational view similar to that of FIG. 5 but of an alternative embodiment.

An alternative embodiment, illustrated in FIG. 8, has a wheel 70 provided with three openings 30 in the peripheral wall 71 rather than four as shown in FIGS. 3–5. Spider 72 is secured to the axle 14 by setscrew 34 through the center 75. Extending radially from the center are three radial legs 76, each of which has a free end 77. As with the embodiment shown in FIGS. 3–5, a claw 40 is attached to each of the legs 76 intermediate the center and the free end by screws 46 or other fasteners. The structure of the hollow wheel 70 is otherwise similar to that of the wheel 16.

While a particular embodiment of the present invention has been illustrated and described with some alternative modification, it will be apparent that further variation, changes and modifications will occur to those skilled in the art. It is intended in the appended claims to cover all such variations, changes and modifications as fall with the true spirit and scope of the present invention.

What is claimed as new and desired to be secured as Letters Patent is:

1. A wheel and axle assembly for a toy vehicle comprising:

a hollow wheel with a peripheral wall mounted for rotation on an axle;

an opening extending through the peripheral wall;

a spider secured to the axle for rotation with the axle within the hollow wheel;

the spider having at least one leg spaced from the axle;

a claw attached adjacent one end to the leg for pivotal movement relative to the leg about an axis generally parallel to the axle forming a spider-claw subassembly;

the claw having a free end distal from the one end;

engagement between the spider-claw subassembly and the wheel;

means biasing the claw to remain within the wheel; and rotation of the axle relative to the wheel in one direction causing the claw to be driven out through the opening upon overcoming the engagement between the spider-claw subassembly and the wheel.

2. The wheel and axle assembly of claim 1 including means preventing the leg from rotating past the opening in the one direction.

3. The wheel and axle assembly of claim 1 in which the opening is a slot generally parallel to the axle.

4. The wheel and axle assembly of claim 3 in which the length of the slot is substantially the entire width of the peripheral wall.

5. The wheel and axle assembly of claim 1 in which the leg extends generally tangent to the axle.

6. The wheel and axle assembly of claim 1 in which the leg is generally radial with respect to the axle.

7. The wheel and axle assembly of claim 1 in which a hinge adjacent the one end permits the pivotal movement of the claw relative to the leg.

8. The wheel and axle assembly of claim 7 in which the claw is formed of a plastic material with the hinge being a reduced thickness of the material and the biasing means is integrally provided by the hinge.

9. A toy vehicle comprising:

a chassis;

an axle carried by the chassis for rotation relative to the chassis;

a hollow wheel mounted on the axle for rotation relative to the axle;

the hollow wheel having a peripheral wall the outside of which contacts a supporting surface for the toy vehicle;

an opening extending through the peripheral wall;

a spider secured to the axle within the wheel for rotation with the axle;

the spider having at least one leg spaced from the axle;

a claw attached adjacent one end to the leg for pivotal movement relative to the leg about an axis generally parallel to the axle forming a spider-claw subassembly;

the claw having a free end distal from the one end;

engagement between the spider-claw subassembly and the wheel;

means biasing the claw to remain within the wheel; and rotation of the axle relative to the wheel in one direction urging the claw to extend out through the opening in opposition to the bias upon overcoming the engagement between the spider-claw subassembly and the wheel.

10. The toy vehicle of claim 9 including:

a motor carried by the chassis; and means drivingly connecting the motor to the axle to rotate the axle in the one direction.

11. The toy vehicle of claim 9 including means preventing the leg from rotating past the opening in the one direction.

12. The toy vehicle of claim 9 in which the opening is a slot generally parallel to the axle.

13. The toy vehicle of claim 12 in which the length of the slot is substantially the entire width of the peripheral wall.

14. The toy vehicle of claim 9 in which the leg extends generally tangent to the axle.

15. The toy vehicle of claim 9 in which the leg is generally radial with respect to the axle.

16. The toy vehicle of claim 9 in which a hinge adjacent the one end permits the pivotal movement of the claw relative to the leg.

17. The toy vehicle of claim 16 in which the claw is formed of a plastic material with the hinge being a reduced thickness of the material and the biasing means is integrally provided by the hinge.

18. A toy vehicle comprising:

a chassis;

a pair of substantially parallel spaced apart axles carried by the chassis for rotation relative to the chassis;

motor means carried by the chassis and drivingly connected to each of the axles to rotate both of the axles in one direction;

a pair of spaced apart hollow wheels mounted on each of the axles for rotation relative to the axle on which each wheel is mounted;

each wheel having a peripheral wall the outside of which contacts a supporting surface for the vehicle;

an opening extending through each peripheral wall;

a spider secured to each axle within each wheel for rotation with each axle;

each spider having at least one leg extending generally transverse to the axle to which the spider is secured;

a claw attached adjacent one end to each leg for pivotal movement relative to the leg to which the claw is attached in the one direction of rotation of the axle to which the spider is attached and in the opposite direction forming a spider-claw subassembly;

means biasing the claw in the opposite direction;

engagement between the spider-claw subassembly and the wheel; and rotation of the axles relative to the wheels urging each of the claws out through the respective openings in opposition to the bias upon overcoming the engagement between the spider-claw subassembly and the wheel.

19. The toy vehicle of claim 18 including means preventing the leg from rotating past the opening in the one direction.

20. The toy vehicle of claim 18 in which the claw is made of a plastic material with an integral hinge formed by a reduced thickness of the material proximal the one end to permit the pivotal movement and provide the biasing means.

* * * * *